US008157224B2

(12) United States Patent
Turvey et al.

(10) Patent No.: US 8,157,224 B2
(45) Date of Patent: Apr. 17, 2012

(54) HANGER

(75) Inventors: Robert R. Turvey, Sanford, MI (US); Michael H. Kennett, Midland, MI (US); Joel T. Cerva, Freeland, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 36 days.

(21) Appl. No.: 12/731,757

(22) Filed: Mar. 25, 2010

(65) Prior Publication Data

US 2011/0233347 A1 Sep. 29, 2011

(51) Int. Cl.
*B65D 33/14* (2006.01)

(52) U.S. Cl. ..... 248/95; 248/340; 248/313; 223/91

(58) Field of Classification Search ..... 248/95, 248/322, 305, 339, 340, 689, 99, 100, 101, 248/214, 313, 316.1; 223/91, 93, 96; 403/353; 383/23, 15, 30, 68; 24/30.5 L, 30.5 R; 211/45, 211/50, 85.15; 206/284–286, 296; 16/422; 2/271

See application file for complete search history.

(56) References Cited

U.S. PATENT DOCUMENTS

| | | | | |
|---|---|---|---|---|
| 1,126,342 | A | | 1/1915 | Bailey |
| 1,223,194 | A | | 4/1917 | Mitchell |
| 1,722,757 | A | | 7/1929 | Levine |
| 2,102,348 | A | | 12/1937 | Balochi |
| 3,176,326 | A | | 4/1965 | Zysman et al. |
| 3,221,848 | A | | 12/1965 | O'Neil |
| 3,484,894 | A | * | 12/1969 | Fletcher ..... 16/422 |
| 3,557,944 | A | | 1/1971 | Crane |
| 3,733,016 | A | | 5/1973 | Rood |
| 4,091,976 | A | | 5/1978 | Morse |
| 4,196,821 | A | * | 4/1980 | Teti et al. ..... 220/756 |
| 4,438,967 | A | | 3/1984 | Fox |
| 4,732,270 | A | | 3/1988 | Myers et al. |
| 5,094,414 | A | | 3/1992 | Eddy, Jr. |
| 5,669,727 | A | | 9/1997 | Wegscheider |
| 6,113,267 | A | | 9/2000 | Roy |
| 6,758,378 | B2 | | 7/2004 | Carmichael |
| 7,007,991 | B1 | * | 3/2006 | Sapp ..... 294/214 |
| 7,284,303 | B2 | * | 10/2007 | Canegallo et al. ..... 24/30.5 R |
| 7,389,885 | B2 | | 6/2008 | Masanek, Jr. |

* cited by examiner

*Primary Examiner* — Terrell McKinnon
*Assistant Examiner* — Ingrid M Weinhold

(57) ABSTRACT

A hanger capable of supporting a bag. A first piece of the hanger includes (i) a first body, with a hanger extending upwardly from the body, (ii) a structure extending from a first side of the first body, and (iii) a cleat extending downwardly from a second side of the first body. The cleat includes a plurality of spaced apart cross members each having a neck portion and a head portion. A second piece of the hanger includes a second body that defines a slotted grove groove receptor for the cleat. The slotted groove receptor includes (i) an opening having a first portion and a second portion, with the first portion being wider than the second portion, and (ii) at least one projecting member provided adjacent to the second portion of the opening. The first piece is removably attached to the second piece with the cleat received in the slotted groove receptor.

19 Claims, 3 Drawing Sheets

HANGER

CROSS REFERENCE TO RELATED APPLICATIONS

Not applicable.

REFERENCE REGARDING FEDERALLY SPONSORED RESEARCH OR DEVELOPMENT

Not applicable.

SEQUENTIAL LISTING

Not applicable.

BACKGROUND OF THE INVENTION

1. Field of the Invention

The present invention relates to a hanger adapted for hanging an item that has a flexible portion, such as a bag, which may be releasably clamped between two portions of the hanger.

2. Description of the Background of the Invention

It is often desirable to have a hanger that is adapted to releasably attach to an item so that the item may be easily hung up from a support such as a hook, rod, or door. Some examples of well known hangers include a shirt hanger, which has a hook extending upwardly from an elongate generally horizontal cross member, over which, a shirt, pants, or other article of clothing simply is draped. The article of clothing is maintained on the horizontal cross member simply by hanging thereover. Such shirt hangers, however, are generally not suitable for hanging heavier items that cannot be easily draped thereover without falling off.

For hanging heavier items or items that are harder or impossible simply to drape over a horizontal cross member, it is known to use multi-part clamping mechanisms, wherein a hook extends upwardly from one side of a main body portion, and a clamping mechanism is carried by or defined by the main body portion for releasably clamping the item between a pair of opposing, generally flat jaws. For example, one hanger specifically adapted for hanging trousers includes a pair of opposing horizontal bars articulably connected at and hanging downwardly from a hinge member that includes a cam mechanism and a hook extending upwardly from the hinge member. Another hanger includes a hook extending upwardly from a single horizontal cross bar and a pair of spring-loaded clamping jaws extending downwardly from and at opposite ends of the horizontal cross bar. Although these types of hangers generally are sufficient for hanging clothes, and the like, they are often limited by the amount of weight that can be held between the jaws without pulling out, which can limit the usefulness for hanging heavier items, such as a bag filled with heavier items.

In order to overcome this limitation of simple jaws-type hangers, it has been known to add gripping members or surfaces to the jaws or simply to dispense with the clamping mechanism and include a member that penetrates into the item itself, such as with a second hook or peg. Of course, such solutions may not be acceptable for use with some items, such as a bag designed to maintain its contents sealed therein, because such mechanisms either puncture the bag and thereby break the desired seal for the contents or require a bag that has been specially constructed with holes and/or grommets to receive the penetrating member.

The inventors of the present invention have recognized that it would be desirable to have a hanger adapted for hanging a heavier item, such as a bag filled with liquids, or the like, that may be releasably clamped between two portions of the hanger without puncturing the bag, in order to maintain the integrity of the bag.

SUMMARY OF THE INVENTION

According to one aspect of the invention, a hanger comprises a first piece and a second piece. The first piece includes a first body, a hanger extending upwardly from the body, and a cleat extending downwardly from the body. The second piece includes a second body that defines a slotted groove receptor for the cleat. The first piece is removably attachable to the second piece by a releasable cleat-and-groove connection of the cleat within the slotted groove receptor, and the slotted groove receptor is sized to receive the cleat and a flexible bag wall therein without puncturing the flexible bag wall.

According to another aspect of the invention, a hanger comprises a hanger piece and a clamp piece that is removably attachable to the hanger piece. The hanger piece includes a cross member having a top side and a bottom side, a means for hanging the cross member from a support member extending upwardly from the cross member above the top side, and a cleat extending downwardly from the cross member below the bottom side. The cleat includes a neck portion projecting from the cross member and a head portion spaced from the cross member, wherein the head portion is wider than the neck portion. The clamp piece comprises a slotted opening for receiving the cleat therein. The slotted opening includes a first portion that accepts the head portion therethrough and a second portion that accepts the neck portion therethrough, but not the head portion. The second portion is immediately adjacent to the first portion. The clamp piece is attached to the hanger piece by fitting the head of the cleat into the first portion of the slotted opening and shifting the neck of the cleat laterally into the second portion of the slotted opening after the cleat is inserted into the first portion. A space is defined between the clamp piece and the cleat when the cleat is inserted within the slotted opening, wherein the space is sufficient to accommodate a flexible sheet of material disposed around the cleat.

A further aspect of the invention includes a method of removably attaching a container to a hanger, wherein the container comprises one or more flexible sidewalls and the hanger comprises a hanger piece and a clamp piece, wherein the hanger comprises a cleat and the clamp piece comprises a slotted groove receptor that accepts the cleat in a cleat-and-groove connection. The method comprises the steps of positioning the flexible sidewall between the cleat and the slotted groove receptor, pressing the flexible sidewall into the slotted groove receptor with the cleat, and sliding the cleat along the slotted groove receptor to lock the cleat and the flexible sidewall therein.

Other aspects and advantages of the present invention will become apparent upon consideration of the following detailed description.

DETAILED DESCRIPTION

In some aspects, a two-piece hanger of the present invention can clamp and hold a sealed bag filled with contents without puncturing the bag by clamping the bag between the two pieces at a cleat-and-groove connection. The hanger includes a hanger piece for hanging from a support and a clamping piece that is removably attachable to the hanger piece. The hanger piece includes a hanger mechanism extending upwardly from a body and a cleat extending downwardly from a lower surface of the body, wherein the cleat preferably includes a neck portion projecting from the lower surface and a bulbous head portion that is wider than the neck portion disposed distal from the lower surface. The clamping piece includes a body having an upper surface and a slotted groove receptor, wherein the slotted groove receptor is defined by a slotted opening through the upper surface into a cavity or groove underneath the upper surface. The slotted opening preferably has a first portion that forms an opening into the cavity or groove and a second portion that forms a slot in the upper surface extending from the opening over the cavity or groove along a longitudinal axis thereof and thereby forming a slotted opening generally having the shape of a keyhole. The first portion comprises an eyehole that is wide enough to accept the head of the cleat therethrough, and the second portion comprises a keyway slot that is narrower than the head of the cleat and wide enough to receive the neck therein. The keyway slot of the second portion may be defined by a collar wall extending partially around the keyway slot over the groove-shaped cavity. The clamping piece may be removably connected to the hanger piece by inserting the head of the cleat into the eyehole and sliding the neck into the keyway slot, whereby the cleat locks the clamping piece to the hanger piece in a cleat-and-groove connection. In order to carry a bag, one or more bag walls of the bag are placed between the cleat and the slotted opening, and the cleat is then inserted into the slotted groove receptor as described above. The bag walls are thereby squeezed into the slotted groove receptor by the cleat and are clamped between the head of the cleat and an underside of the collar wall when the cleat is in the keyway slot. A spring optionally may be disposed between the clamping piece and the hanger member that urges the clamping piece and the hanger piece together when attached to the bag. The cleat and the slotted groove receptor preferably are sized and shaped so as to not puncture the bag walls when the bag is hung on the hanger, which allows the bag to be substantially unaffected by the hanger and allows the hanger to be used with almost any bag, without requiring any special features to be added to the bag.

Figure 1:
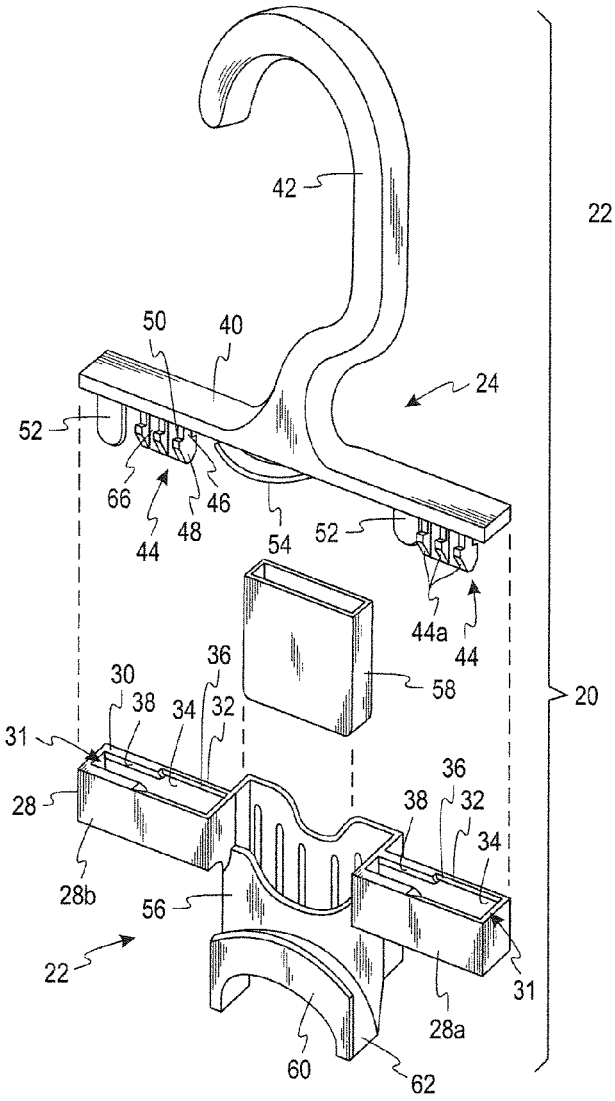
FIG. 1 is an exploded isometric view of a hanger according to the present invention in a disassembled state.
Figure 2:
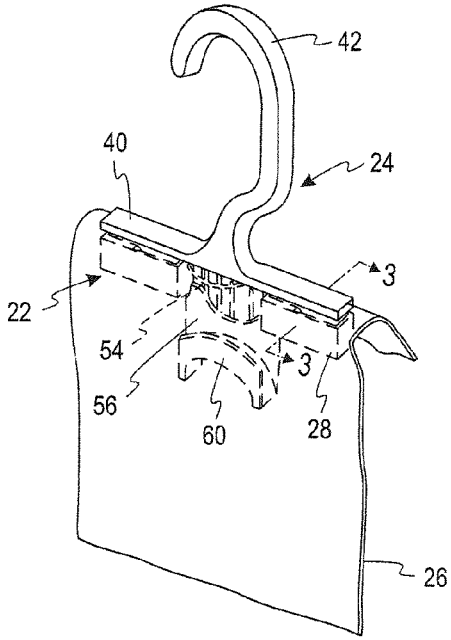
FIG. 2 is an isometric view of the hanger of FIG. 1 in an assembled state and having a flexible-walled bag clamped therein.
Figure 3:
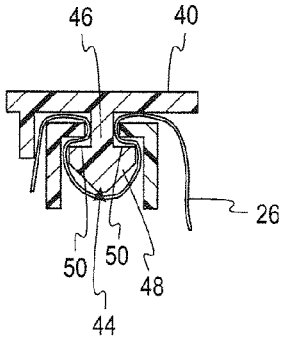
FIG. 3 is a cross-sectional view along the line 3-3 in FIG. 2.

Turning now to the drawings, in which the same reference numerals indicate the same or similar structures, FIG. 1 shows a hanger 20 according to aspects of the invention, wherein the hanger 20 includes a first piece 22 adapted for removable attachment to a second piece 24 that can be hung from a support member (not shown). FIGS. 2 and 3 show the hanger 20 with a bag 26 attached and suspended therefrom. The hanger 20 can be repeatedly attached to and removed from a bag 26 made of flexible material in order to hang the bag 26 without puncturing the bag material. The bag 26 may be any container having flexible bag walls, such as thermoplastic sandwich bags or garment bags, cloth bags, foil bags, or any other material that is flexible enough to be manipulated in the hanger 20 as described herein. Further, the hanger 20 may be used with hard walled containers or other products, if the container or product includes a flexible wall that may be engaged by the various hangers, as described herein below.

The first piece 22, or clamping piece, includes a base member 28, wherein the base member 28 includes a top wall 30 having a pair of slotted groove receptors 31, wherein each slotted groove receptor 31 is defined by a slotted opening 32 through the top wall having a stepped width generally in the shape of a keyhole and extends into a cavity 34 therebelow. Each slotted opening 32 has a length extending from an eyehole 36 at a first end to a keyway slot 38 at a second end, a first width at the first end, and a second width at the second end that is less than the first width. Preferably, though not necessarily, each of the first width and the second width is constant along the respective length thereof. The width at the second end is defined by a portion of the top wall 30 that projects over the cavity, such as a slotted collar, that thereby defines a bottom surface that extends over the cavity 34. The slotted openings 32 preferably are aligned along the lengths thereof. The base member 28 may be, for example, a hollow tube member as shown in FIGS. 1-3, a channel member as discussed elsewhere herein, or other shapes, types, and combinations of members may be used within the scope of the invention. For example, although the top wall 30 of the base member shown in FIG. 1 is separated into two spaced-apart sections 28*a*, 28*b* connected by an intermediate offset wall section for a basket as described later herein, the functioning of the slotted openings 32 is not altered by such an arrangement.

The second piece 24, or hanger piece, includes a body defining a plate 40 that is attachable to the first piece 22 by a cleat-and-groove connection into the slotted groove receptors 31. A hook 42 extends upwardly from a top surface of the plate 40 such that the hanger 20 (and a bag 26) can be suspended therefrom. The specific form of the hook 42 may have many different shapes or attributes without departing from the spirit of the invention, as long as the hook 42 is adapted to suspend the hanger 20 from a support surface, such as a peg, door handle, hanger rod, hook, wall, or the like. Some additional exemplary hanging mechanisms may include, for example, a ring, a loop, a magnet, a string, a cable, an elastic chord, and a hook-and-loop fastener. Two cleats 44 extend downwardly from a bottom surface of the plate 40, wherein each cleat 44 is sized to fit through the eyehole 36 of a respective slotted opening 32 into the slotted groove receptor 31. Preferably, the cleats 44 are aligned along a length on the plate 40. As best seen in FIG. 3, each cleat 44 includes a narrow portion, or neck 46, extending from the bottom surface of the plate 44 and a bulbous head 48 at a distal end of the neck 46 defines opposing lateral shoulders 50. In any form, the heads 48 of the cleats 44 may be inserted into the eyeholes 36 of the respective slotted openings 32, and the cleats 44 can be slid longitudinally into the keyway slots 38, such that the necks 46 fit within the keyway slots 38 and the heads 44 are wider than the keyway slots 38, so as to retain the cleats 44 within the slotted groove receptors 31 in a cleat-and-groove locking arrangement.

In use, the base member 28 is positioned on one side of a flexible wall or walls of the bag 26, and the cleats 44 and plate 40 are positioned on an opposite side of the bag walls. The cleats 44 are pushed into the eyeholes 36, thus causing the bag walls to deform around and cleats 44 and be pressed into the slotted groove receptors 31. Preferably, the cleats 44 have rounded or gently angled heads 48, without sharp corners, in order to minimize the potential for gouging the bag walls. The plate 40 is slid longitudinally, moving the necks 46 into the keyway slots 38, whereby the first and second pieces 22, 24 of the hanger 20 are locked together with the bag walls disposed therebetween. As best seen in FIG. 3, the bag walls are clamped between the shoulders 50 of the head 48 of the cleat 44 and the bottom surface of the top wall 30 of the base member 28 as gravity causes the bag 26 to pull the base member 28 downwardly on to onto the shoulders 50. The hanger 20 may then be hung from any sufficient support member, such as a rod or hook, in a convenient manner. To release the bag 26 from the hanger 20, the cleats 44 are slid back into the eyeholes 36 and removed from the slotted openings 32, thereby releasing the bag 26 from between the plate 40 and the base member 28. Preferably, the slotted groove receptors 31 are oversized to provide a space between the cleats 44 and the slotted openings 32 sufficient to allow the bag walls to easily fit therebetween when the bag walls are pressed into the slotted openings 32 without damaging the bag walls.

Guide members 52, such as flanges, optionally, are disposed on each opposite end of the plate 40 near the respective cleat 44. The guide members 52 are also preferably disposed on opposite sides of the plate 40 and spaced laterally from the cleats 44 sufficiently to allow the cleats 44 to slide into the slotted openings 32 with the bag walls therebetween, as shown in FIG. 3. The guide members 52 can help guide the cleats 44 into the slotted openings 32 and form a guide track for sliding the cleats 44 into the keyway slots 38. In addition, the guide members 52 can also further assist to secure the bag walls between the first piece 22 and the second piece 24, as shown in FIG. 3, depending on the lateral spacing of the guide members 52 from the cleats 44.

A resilient member, such as a spring 54, optionally may be disposed between the base member 28 and the plate 40 to further urge the base member 28 downwardly onto the shoulders 50 of the heads 48 of the cleats 44. In a preferred arrangement, one or more springs 54, such as a leaf-type spring, are disposed on the bottom surface of the plate 40 to urge the top wall 30 of the clamping piece 22 firmly against the heads 48 of the cleats 44. The spring or springs 54 are preferably located between the cleats 44. Other arrangements of a resilient spring member sufficient to urge the base member 28 downwardly onto the shoulders 50 of the cleats 44 may also be used. For example, one or more resilient members may alternatively or additionally be carried by the clamp piece 22 to engage against the hanging piece 24.

The clamping piece 22 further may include a basket 56 for carrying a removable cartridge 58 that may include, for example, a scent carrier or odor eliminator to counteract possible odors from the bag or its contents. As shown in FIG. 1, the basket 56 hangs downwardly from the base member 28 below an offset area of the top wall 30 and has an open top and, preferably, one or more slotted sidewalls. The removable cartridge 58 slides into the basket 56 when the hanger piece 24 is not attached to the clamping piece 22. Further, the removable cartridge 58 cannot be removed from basket 56 when the hanger piece 24 and the clamping piece 22 are attached. Thus, when the bag 26 is secured between the hanger piece 24 and the clamping piece 22, the removable cartridge 58 cannot fall out of the basket 56 accidentally, regardless of the orientation of the hanger 20.

The clamping piece 22 further may include a support member for carrying another hook. As shown in FIG. 1, one possible such support structure may include saddle structure 60 forming an arched groove 62 projecting outwardly from the basket 56 underneath the base member 28, whereby another hook can seat into the groove 62.

As shown in FIGS. 1 and 3, the heads 48 of the cleats 44 may have straight, horizontal shoulders 50 that engage against straight horizontal lower surfaces of the top wall 30 of the base member 28. Each cleat 44 preferably comprises two, three, or more spaced apart cross members **44*a*, wherein the cross members 44*a* are axially aligned, and each cross member 44*a* individually defines the neck 46, head 48, and shoulders 50, and a central longitudinal spine member 66 joins adjacent pairs of cross members 44*a* in the cleat 44. The spaced apart cross members 44*a* of the cleat 44 thereby define gaps at intervals along each shoulder 50. Each cross member 44*a* preferably has the same profile shape, and the cross members 44*a*** are preferably aligned longitudinally along an imaginary prismatic surface.

Figure 4:
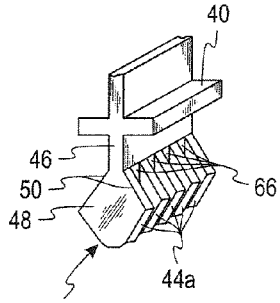
FIG. 4 is an isometric partial view of a locking mechanism suitable for use with the hanger of FIG. 1.
Figure 5:
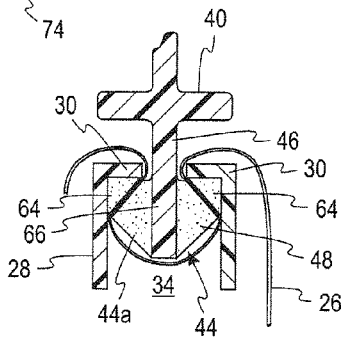
FIG. 5 is a cross-sectional view of the locking mechanism of FIG. 4 as installed on the hanger of FIG. 1 and seen along the line 3-3 in FIG. 2.

An alternative design for the cleats 44, as shown in FIGS. 4 and 5, is substantially similar to the cleats shown in FIGS. 1 and 3, except that the shoulders 50 are angled downwardly. Preferably, the slotted groove receptors 31 are also modified such that the base member 28 also includes angled bottom surfaces under the top walls 30, such as diagonal moldings 64, that are complementary to the downwardly angled shoulders 50, wherein the diagonal moldings 64 engage against the downwardly angled shoulders 50 when the heads 48 of the cleats 44 are under the keyway slots 38. Each diagonal molding 64 may comprise a single solid surface. Alternatively, each or either diagonal molding 64 may be divided into longitudinally spaced apart plate-like members, as discussed subsequently herein, similar to the spaced apart cross members **44*a*, whereby the cleat-and-groove connection of FIGS. 4 and 5 may, in some cases, provide additional resistance to accidental disengagement. Other shapes and forms of the cleats 44** may also be used, as long as the cleat can be inserted into the wide end of a slotted opening and can slide to a narrower end of the slotted opening, thereby locking the cleat into the slotted opening. For example, the cleat may be defined by a single unitary head and neck combination, such as a single elongate tubular member rather than a plurality of aligned plate-like members, and may take other forms sufficient to provide cleat-and-groove interlocking with the slotted openings described herein, as shown and described elsewhere herein and/or in other forms consistent with the interlocking function of the cleat.

Figure 6:
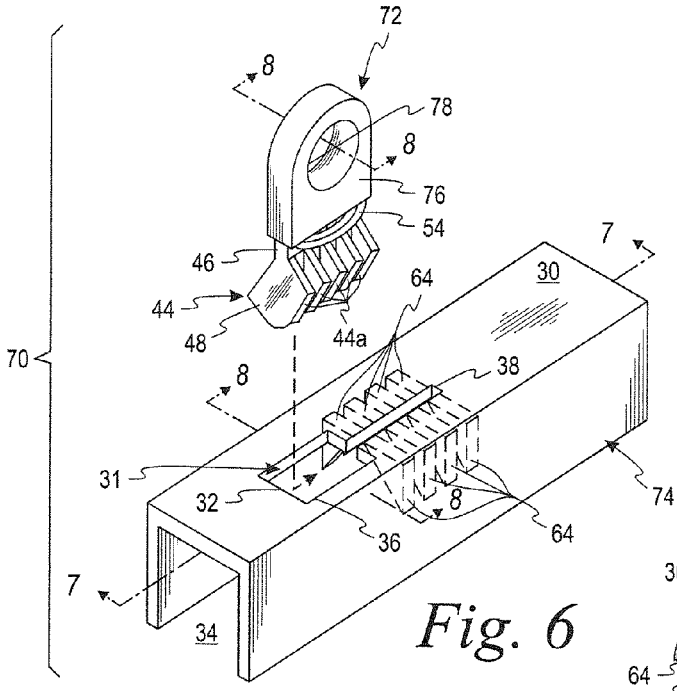
FIG. 6 is an exploded isometric view of another hanger according to the present invention in a disassembled state.
Figure 8:
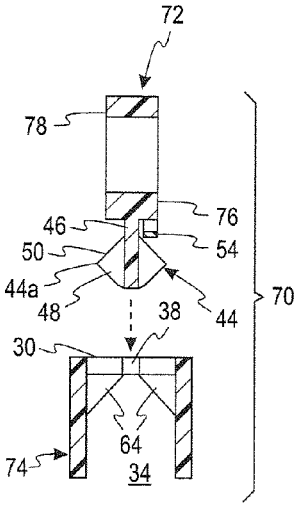
FIG. 8 is a cross-sectional view of the hanger of FIG. 6 along the lines 8-8 of FIG. 6.
Figure 7:
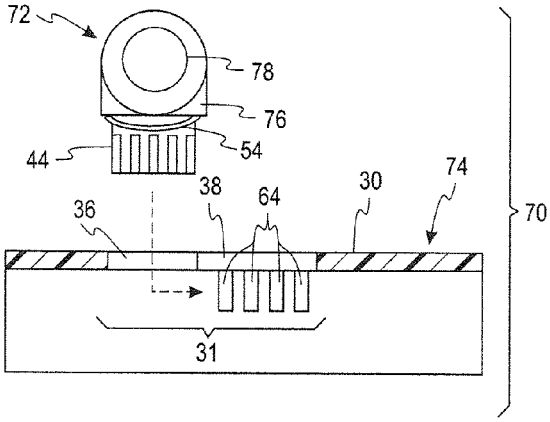
FIG. 7 is a side view of the hanger of FIG. 6 in partial cross section, generally along line 7-7 of FIG. 6.

Turning now to FIGS. 6-8, a hanger 70 according to further aspects of the invention is shown, wherein the hanger 70 is functionally similar to the hangers 20 of FIGS. 1-5 in many ways, but includes fewer cleats 44 hanging from a body of the hanger piece and corresponding correspondingly fewer slotted groove receptors 31 in the clamping piece, and also has a different hanging mechanism. Similar to the hanger 20 of FIGS. 1-5, the hanger 70 includes a hanger piece 72 that is releasably securable to a clamping piece 74 by way of a cleat-and-groove connection of a cleat 44 within a slotted groove receptor 31. However, the hanger piece 72 includes a hanging mechanism, such as a body 76 defining an eyelet 78, such as a circular ring, and a single cleat 44 projecting downwardly from a bottom portion of the body 76 directly below the eyelet 78. The cleat 44 and slotted groove receptor 31 are similar to the cleat 44 and slotted groove receptor 31 shown in FIGS. 4 and 5. Of course, other cleat-and-groove designs as disclosed or suggested herein could also or alternatively be used.

The clamping piece 74 has the form of an elongate channel-member with two side walls depending downwardly from opposite sides of a top wall, thereby defining a bottom cavity and open opposite ends, as shown in FIGS. 6-8. A single slotted opening 32 is defined through the top wall, wherein the slotted opening 32 has an eyehole 36 adjacent to a keyway slot 38, a first width at the eyehole 36, and a second, narrower width at the keyway slot 38, as shown and described previously herein. Further, as described previously herein, the first width is sufficient to receive the head portion 48 of the cleat 44 therethrough with enough extra room to accommodate a flexible bag wall or walls, and the second width is sufficient to receive the neck portion 46 of the cleat 44 therein with enough extra room to also accommodate the flexible bag walls, and is also narrow enough to prevent the head portion 48 from being pulled therethrough. A plurality of diagonal moldings 64 projects downwardly from the top wall on each opposite side of the keyway slot 38, wherein the diagonal moldings 64 are complementary to the shoulders 50 of the cross members 44*a* of the cleat 44 and aligned such that the head 48 of the cleat slides longitudinally past the diagonal members. The diagonal moldings 64 on each side of the keyway slot 38 are spaced apart longitudinally such that the cross members 44*a* of the cleat 44 can interfit alternatingly between the diagonal members 64. Such interfit may in some instances provide an additional locking function to prevent the cleat 44 from accidentally sliding longitudinally out of the keyway slot 38 because, for example, the spaces between the diagonal moldings 64 may create a position of lower stress for the cross members 44*a* when the bag walls are disposed therebetween than when the cross members 44*a* are directly aligned with the diagonal moldings 64 without the alternating interfit. Similar longitudinal locking functionality may be obtained by using even a single projecting member that interfits with a gap in a shoulder of a cleat and may also be adapted for use with a head of any profile shape, such as with the horizontal shoulders 50 shown in FIGS. 1 and 3. Thus, similar to the embodiment shown in FIGS. 1-5, a flexible walled bag 26 may be suspended between the clamping piece 74 and the hanger piece 72 by pressing the bag walls into the cavity of the channel member through the eyehole 36 of the slotted opening 32 with the head 48 of the cleat 44. The neck 46 of the cleat 44 may then be slid sideways into keyway slot 38 and the top wall of the channel member prevents the head 44 from being pulled out directly through the keyway slot 38.

A resilient member, such as a leaf-type spring 54 projecting downwardly from the body 76 of the hanger piece 72, presses downwardly against the clamping piece 74 when the cleat 44 is attached in the slotted opening 32 and can help to clamp the bag walls between the hanger piece 72 and the clamping piece 74 and further help to lock the two pieces 72, 74 together.

Figure 9:
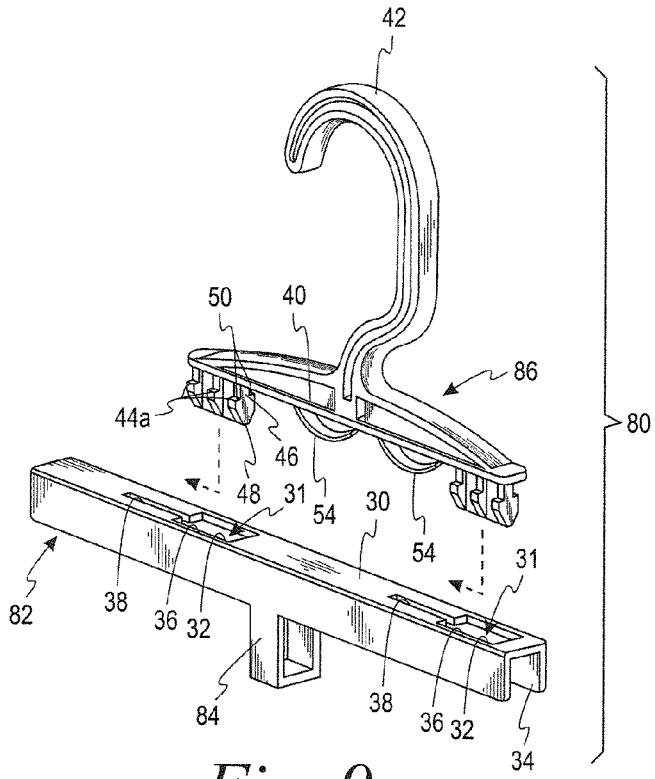
FIG. 9 is an exploded isometric view of a further hanger according to the present invention in a disassembled state.
Figure 10:
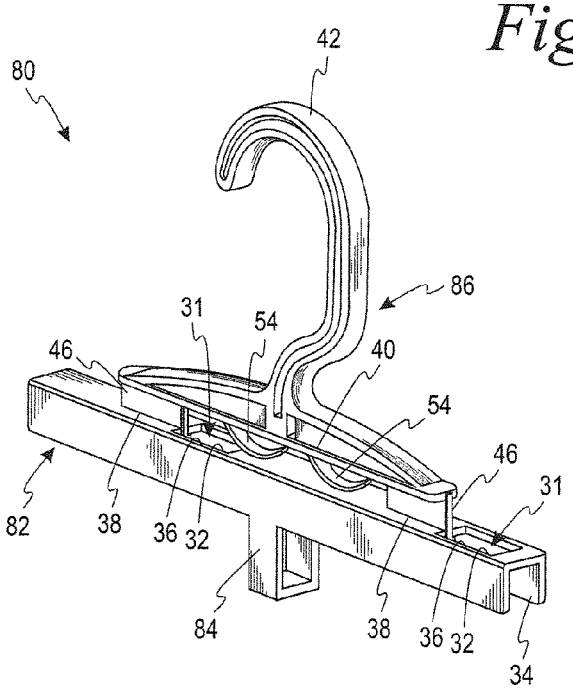
FIG. 10 is an isometric view of the hanger shown in FIG. 9, in an assembled state.

Turning now to FIGS. 9 and 10, a hanger 80 according to additional aspects of the invention has many similar functionalities and features as the hanger 20 shown in FIGS. 1-5, except that a clamping piece 82 does not include the basket 56 for carrying the removable cartridge 58 or a saddle 60 for carrying another hook. Rather, the clamping piece 82 includes a support member in the form of a U-shaped member 84 projecting downwardly from a body of the clamping piece 82, wherein a hook may be hooked through the U-shaped member 84. Further, the clamping piece 82 is in the form of a single channel member similar to that shown in FIGS. 6-8, and includes slotted groove receptors 31 defined by two slotted openings 32 through the top wall of the channel member that accept two downwardly projecting cleats 44 from a hanger piece 86 in a cleat-and-groove connection, as described previously herein. Although the cleats 44 are shown as having straight horizontal shoulders 50, as shown in FIGS. 1 and 3, the cleat-and-groove connections may take other forms as disclosed elsewhere herein. Two leaf-type springs 54 are disposed on a bottom surface of a plate 40 defined by a body of the hanger piece 86. The springs 54 engage against the top wall of the clamping member 82 when the cleats 44 are inserted into the slotted groove receptors 31, as shown in FIG. 12. Other aspects of the hanger 80 are generally similar to the hanger 20 of FIGS. 1-5 and may be seen from the drawings and with reference to the descriptions provided herein without further detailed elaboration.

In some embodiments, other types of cleat-and-slot connectors may be used, such as a T-slot and T-nut or T-bolt, a dovetail and groove, a pin with a lug head in a key slot, etc. Further, the slotted opening may, in some cases, simply include a keyway slot that opens at an end of a body member, such as a keyway slot that is open to an end of a channel member.

The hangers of the present invention, such as hangers 20, 70, 80 disclosed herein, may be made of metal, wood, thermoplastic, or any other material suitable for supporting a bag, and may be manufactured by any of many different methods, all as would be readily apparent to a person of skill in the art. For example, a bag hanger as disclosed herein may be formed of thermoplastic and manufactured by known injection molding techniques.

INDUSTRIAL APPLICABILITY

The bag hangers shown and described herein may be used advantageously in some aspects to hang a flexible walled bag, such as a thermoplastic freezer bag, without puncturing the bag walls or disrupting a seal thereon and without requiring any specialized structures to be molded into the bag.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out the same. The exclusive rights to all modifications that come within the scope of the appended claims are reserved. All patents, patent applications, and other printed publications identified in the foregoing description are incorporated by reference in their entireties herein.

We claim:

1. A hanger capable of supporting a bag, the hanger comprising:

a first piece that includes (i) a first body, (ii) a structure extending from a first side of the first body, and (iii) a cleat extending from a second side of the first body, the cleat including a plurality of spaced apart cross members each having a neck portion and a head portion; and a second piece that includes a second body that defines a slotted groove receptor for the cleat, the slotted groove receptor including (i) an opening having a first portion and a second portion, with the first portion being wider than the second portion, and (ii) at least one projecting member provided adjacent to the second portion of the opening, wherein the first piece is removably attached to the second piece with the cleat received in the slotted groove receptor such that the neck portions of the cleat are accommodated in the second portion of the opening and such that the head portions of the cleat cannot pass through the second portion of the opening, and with the projecting member being positioned between adjacent cross members of the cleat.

2. The hanger of claim 1, further including a resilient member disposed between the first piece and the second piece, wherein the resilient member urges the second piece against the cleat within the slotted groove receptor.

3. The hanger of claim 2, wherein the resilient member comprises a leaf-type spring carried by the first body.

4. The hanger of claim 3, wherein the first piece further comprises a second cleat and the second piece further comprises a second slotted groove receptor, wherein the first cleat and the second cleat are received within the first slotted groove receptor and the second slotted groove receptor, respectively, in a cleat-and-groove connection.

5. The hanger of claim 1, wherein the cleat comprises a plurality of a projecting members, and wherein the projecting members interfit between adjacent cross members when the cleat is in the second portion of the slot.

6. A hanger capable of supporting a bag, the hanger comprising:

(A) a hanger piece comprising:

(a) a plate having a first side and a second side;

(b) a structure extending from the first side of the plate, the structure including an element configured to allow for the hanger to be suspended from another structure; and c) a cleat including a plurality of cross members, with each of the cross members including (i) a neck portion extending from the second side of the plate, and (ii) a head portion extending from the neck portion, with the head portion being wider than the neck portion; and (B) a clamp piece that is removably attachable to the hanger piece, the clamp piece including a slotted opening for receiving the cleat, with a first portion of the slotted opening being wide enough to allow respective portions of the cross members of the cleat to pass through the slotted opening to a cavity in the clamp piece, and with a second portion; of the slotted opening being wide enough to accommodate respective neck portions of the cross members of the cleat, but not wide enough to allow the respective head portions of the cross members of the cleat to pass therethrough, wherein the clamp piece is attached to the hanger piece by passing the head portions of the cross members of the cleat through the first portion of the slotted opening to the cavity of the clamp piece, and then shifting at least one of the clamp piece and the hanger piece such that the neck portions of the cross members are accommodated in the second portion of the slotted opening.

7. The hanger of claim 6, wherein the structure of the hanger piece comprises a hook, and wherein the first portion of the slotted opening comprises an eyehole.

8. The hanger of claim 6, further comprising a resilient member, wherein the resilient member urges the clamp piece against the head portions of the cleat.

9. The hanger of claim 8, wherein the resilient member is carried by the plate.

10. The hanger of claim 6, further comprising a second cleat extending from the second side of the plate and a second slotted opening in the clamp piece, wherein the first and second cleats are disposed on opposite sides of the hanger piece, and wherein the first and second cleats are spaced to be inserted simultaneously into the first and second slotted openings, respectively.

11. The hanger of claim 10, further comprising a compartment carried by the clamp piece and a cartridge that fits into the compartment, wherein the plate prevents removal of the cartridge from the compartment when the hanger piece is attached to the clamp piece.

12. The hanger of claim 11, further comprising a saddle member carried by the compartment, wherein the saddle member is spaced below the plate and is adapted to carry a hook thereon.

13. The hanger of claim 6, further comprising a guide member extending downwardly from the plate, wherein the guide member is spaced from the cleat, and wherein a portion of the clamp piece is disposed between the guide member and the cleat when the cleat is inserted into the slotted opening and the guide member guides the cleat into the slotted opening.

14. The hanger of claim 6, wherein the head portion has a downwardly angled shoulder extending away from the neck portion, and the clamp piece further comprises an angled surface in the slotted opening that is complementary to and engages against the angled shoulder when the clamp piece is attached to the hanger piece.

15. The hanger of claim 6, wherein the cleat and the slotted opening further comprise means to prevent the cleat from sliding longitudinally out of the second portion of the slotted opening.

16. A method of removably attaching a container to a hanger, wherein the container comprises one or more flexible sidewalls and the hanger comprises a hanger piece and a clamp piece, wherein the hanger comprises a cleat including a plurality of cross members that each include a neck portion and a head portion, and the clamp piece comprises a slotted groove receptor with a projecting member, with the slotted groove receptor accepting the cleat in a cleat-and-groove connection, the method comprising the steps of:

positioning the flexible sidewall between the cleat and the slotted groove receptor;

pressing the flexible sidewall into the slotted groove receptor with the cleat; and sliding the cleat along the slotted groove receptor such that the projecting member is positioned between cross members of the cleat, and so as to lock the cleat and the flexible sidewall therein.

17. The method of claim 16, further comprising the step of suspending the hanger from a support surface.

18. The method of claim 16, wherein the flexible sidewall is not punctured by the cleat during the pressing step.

19. The method of claim 16, wherein the flexible sidewall is not punctured by the cleat during the sliding step.

* * * * *